US007478966B2

(12) United States Patent
Hoogland

(10) Patent No.: US 7,478,966 B2
(45) Date of Patent: Jan. 20, 2009

(54) FILES AND METHOD FOR PRESENTING FILES

(75) Inventor: Hendricus Antonius Hoogland, Krommenie (NL)

(73) Assignee: Fountain Technologies B.V., LC Capelle A/D Ijssel (NL)

( * ) Notice: Subject to any disclaimer, the term of this patent is extended or adjusted under 35 U.S.C. 154(b) by 77 days.

(21) Appl. No.: 10/501,587

(22) PCT Filed: Jan. 14, 2003

(86) PCT No.: PCT/NL03/00021

§ 371 (c)(1),
(2), (4) Date: Mar. 21, 2005

(87) PCT Pub. No.: WO03/057504

PCT Pub. Date: Jul. 17, 2003

(65) Prior Publication Data

US 2005/0228764 A1 Oct. 13, 2005

(30) Foreign Application Priority Data

Jan. 14, 2002 (NL) ..... 1019739

(51) Int. Cl.
*B42F 3/00* (2006.01)
*B42F 13/12* (2006.01)
*B42F 13/00* (2006.01)

(52) U.S. Cl. ..... 402/75; 402/70

(58) Field of Classification Search ..... 402/19, 402/20, 26, 31, 34, 70, 73, 80 R, 500, 502, 402/41, 60, 66, 69, 75; D19/26, 27
See application file for complete search history.

(56) References Cited

U.S. PATENT DOCUMENTS

| | | | | | |
|---|---|---|---|---|---|
| 2,570,323 | A * | 10/1951 | Condon et al. | 402/35 |
| 4,434,534 | A * | 3/1984 | Handler | 24/67.1 |
| 4,484,830 | A * | 11/1984 | Anderson | 402/77 |
| 5,158,386 | A * | 10/1992 | Mann, Jr. | 402/41 |
| 5,975,576 | A | 11/1999 | Vogel | |
| 6,773,653 | B2 * | 8/2004 | Miller et al. | 264/447 |
| 2002/0146275 | A1 * | 10/2002 | Gerriet | 402/70 |
| 2005/0141952 | A1 * | 6/2005 | Schneider et al. | 402/70 |

FOREIGN PATENT DOCUMENTS

| | | |
|---|---|---|
| DE | 295 05 277 U1 | 9/1996 |
| DE | 197 09 720 A1 | 9/1997 |
| EP | 0 482 354 A1 | 4/1992 |
| FR | 2 268 648 | 11/1975 |
| WO | WO 93/24335 | 12/1993 |

* cited by examiner

*Primary Examiner*—Derris H Banks
*Assistant Examiner*—Pradeep C Battula
(74) *Attorney, Agent, or Firm*—Hoffmann & Baron, LLP

(57) ABSTRACT

A file (100), provided with at least a front cover (2), a back cover (3), a spine (4) and at least one arch for fastening paper and the like, wherein the front cover (2), the back cover (3) and the spine (4) are manufactured in one piece, preferably by injection molding from plastic, hinges (5, 6) being co-formed for connecting the covers with the spine (4), coupling means being provided for fastening the or each arch to one of the covers (3,4) or the spine (4).

16 Claims, 5 Drawing Sheets

FILES AND METHOD FOR PRESENTING FILES

This application is the U.S. National Phase of International Application Number PCT/NL03/00021 filed on 14 Jan. 2003, which is incorporated herein by reference.

BACKGROUND OF THE INVENTION

The invention relates to a file. The invention particularly relates to a file with at least an arch for fixing paper and the like.

Files are conventionally provided with a front cover, a back cover and a spine, manufactured from cardboard, if required enclosed in a plastic coating sealed therearound. Front cover, back cover and spine are interconnected by hinges. Fixed on the back cover is an arch by means of pop rivets, blind rivets or the like, by which a fixed connection is obtained. The arch consists mainly of, for instance, two, four or twenty ring elements, which can be divided by means of an opening and closing mechanism, so that paper with perforations can be slid thereon, after which the rings are closed to fix the paper. Such files are, for instance, known as multi-ring, two-ring or four-ring files or the like.

These known files have the disadvantage that they occupy relatively much space in empty condition. In fact, the two covers cannot be folded together, because the or each arch is closed therebetween, while files in open condition, in which the front cover, the back cover and the spine are approximately in one plane, cannot be stacked, because the arches project thereabove. A further disadvantage of these known files is that their manufacture is relatively complicated, so that they are very expensive. Moreover, the metal parts can easily lead to damage to the papers to be stored in the file and to the surroundings, in particular through the metal fastening means.

The invention has for its object to \provide a file for the type described in the opening paragraph, in which the above disadvantages are avoided, while retaining the advantages thereof. To this end, a file according to the invention is characterized by a front cover, a back cover and a spine manufactured in one piece, preferably by injection molding from plastic, with hinges being co-formed for connecting the covers with the spine, and further including a coupling means having a clamping means, with which an arch can be fixed to one of the covers and/or the spine.

SUMMARY OF THE INVENTION

In a file according to the invention, the advantage is obtained that the arch or arches and the cover, built up from front cover, back cover and spine, can be manufactured, stored and transported apart from each other, while they can be relatively simply coupled to compose a suitable file. Preferably, the cover is manufactured by injection molding with integrated hinges, with first coupling means being co-formed, while the arches are provided with second coupling means, for cooperation therewith. Injection molding of the cover has the advantage that it can be formed in a very rapid and simple manner, without sharp parts and consisting of one piece, so that further production steps are not necessary, other than the above simple coupling of first and second coupling means, preferably directly before use.

The covers can simply be stacked flat on each other, in open condition or in folded condition, while the arches can be packed separately. As a result, the files occupy very little space.

In an advantageous embodiment, the or each arch can be slid with the second coupling means in the form of guide means into the first coupling means in the form of further guide means and can be fixed therein by resilient clamping means. As a result, coupling is possible in a very simple manner, while forces acting thereon during use cannot simply release the arch.

The first coupling means may be co-injection molded in plastic, but may also be co-injection molded as inserts, for instance metal or plastic inserts.

When plastic injection molding the covers, it is preferred that at least a part of the outside of the cover, in particular a part of the spine, is provided with a surface that can be written on, in particular by labeling. In a very advantageous form, use is thereby made of in-mold labeling. As a result, a file with a pleasant appearance and practical usability can be obtained in an even simpler manner. The cover, for that matter, can be provided, in particular on the outside, with a desired structure by in-mold labeling.

The cover is preferably provided with stiffening means, such as ribs, ridges or the like, preferably on the side of the cover facing inward. As a result, the cover can be injection molded relatively thin, resulting in a short cycle time and relatively little material, while there is yet obtained a pleasant appearance attended with sufficient stiffness.

The invention further relates to a set of a cover and at least an arch, the cover being provided with first coupling means and the arch with second coupling means, such that the or each arch can be easily connected with a cover to form a file.

Moreover, the invention relates to a method for presenting files, characterized by covers, each comprising a front cover, a back cover and a spine, interconnected by hinges, in particular integrated hinges, which covers are provided with first coupling means, comprising clamping means, arches further being presented, arranged to fix paper or the like, which arches are provided with second coupling means for cooperation with the first coupling means, in particular the clamping means, the covers and arches being presented apart from each other, such that a cover and at least one arch can be combined to a file directly before use.

In such a method, covers can be packed in flat or folded condition, at least stacked in a relatively small space, while the arches can be stored apart therefrom. Only later, for instance just before use, do the files need to be composed.

BRIEF DESCRIPTION OF THE DRAWINGS

In the further subclaims, further advantageous embodiments of a file or method according to the invention are given. In explanation of the invention, embodiments of a file, set and method according to the invention will be explained in more detail with reference to the drawing. In this drawing:

DETAILED DESCRIPTION OF THE INVENTION

Figure 1:
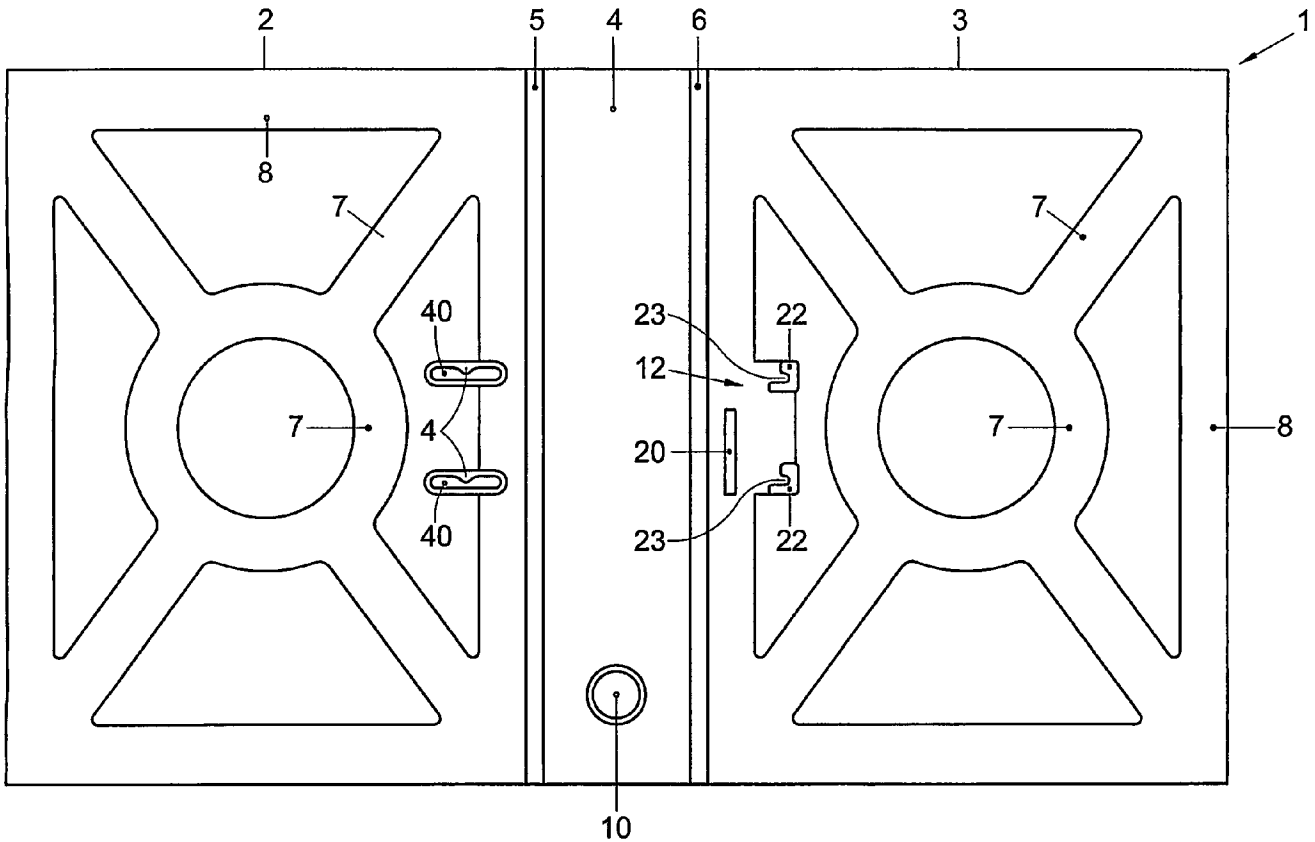
FIG. 1 shows a cover of a file according to the invention, in open condition, seen from the inside.

In this specification, similar or corresponding parts have similar or corresponding reference numerals.

Figure 2:
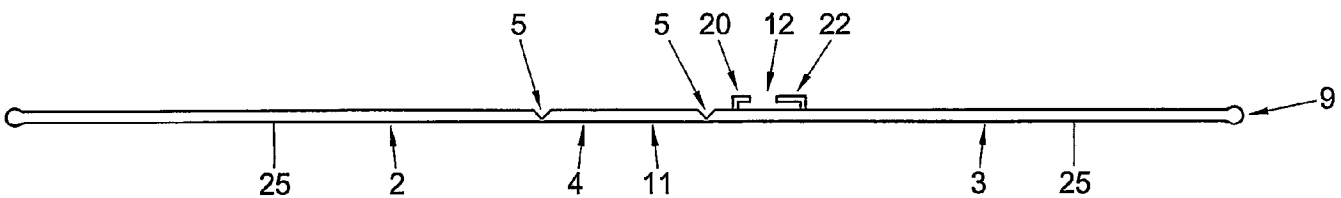
FIG. 2 shows, in side view and in open condition, the cover according to FIG. 1.
Figure 8:
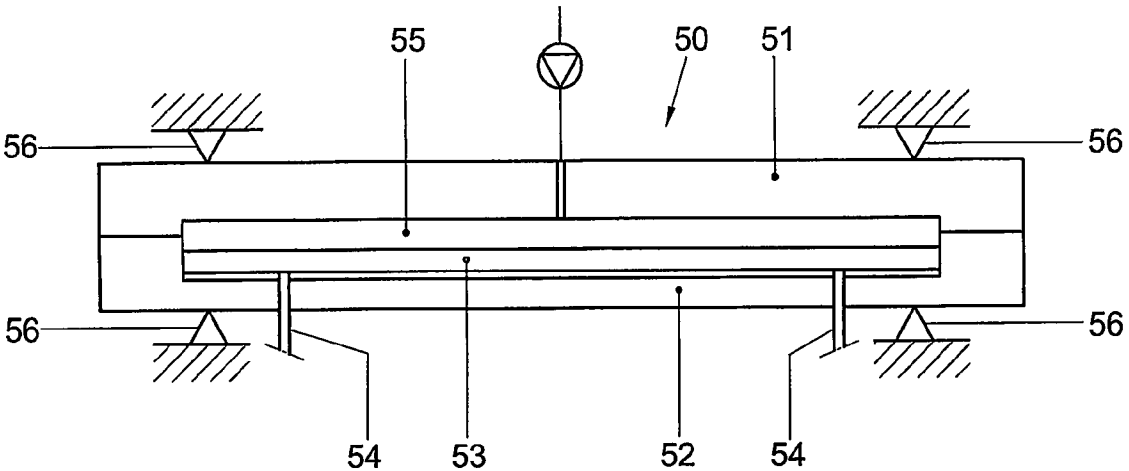
FIG. 8 diagrammatically shows, in cross-sectional side view, a mold for manufacturing a cover according to FIGS. 1 and 2, in a first phase of manufacture.
Figure 9:
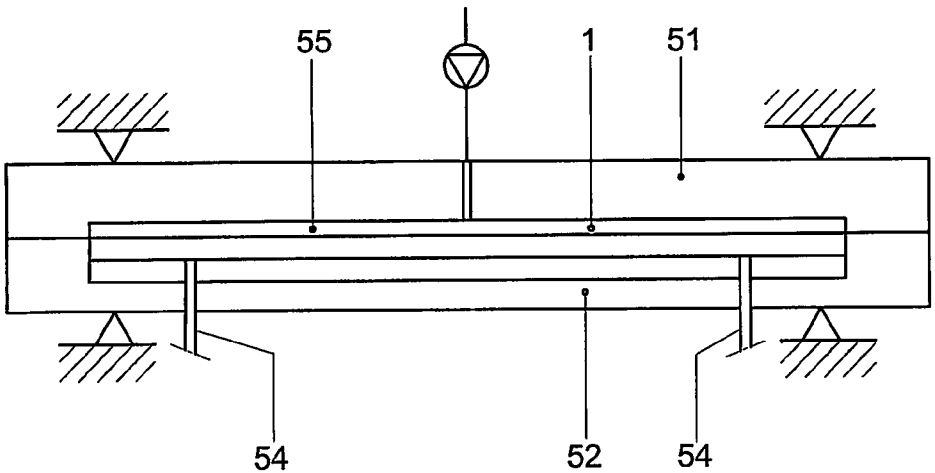
FIG. 9 shows the mold according to FIG. 8 during a second phase of manufacture of the cover.

FIG. 1 shows, in open condition, seen from the inside, a cover 1 for a file 100 according to the invention, which cover is provided with a front cover 2, a back cover 3 and a spine 4, hingedly interconnected via hinges 5, 6. The cover 1 is preferably manufactured in one piece by injection molding, for instance as specified below, in a mold as shown in FIGS. 8 and 9. The cover may be simply injection molded in the relatively flat position shown in FIGS. 1 and 2, the hinges 5, 6 being of the living hinge type. Suitable plastics will be directly clear to those skilled in the art.

To stiffen at least the front cover 2 and the back cover 3, stiffening ribs 7 and a slightly thickened edge 8 are provided, the edge being rounded on the outside 9 for embellishment and to simplify the manufacture. Moreover, such a rounding is advantageous during use and damage is thereby prevented in a simpler manner. In the spine 4 is shown an opening 10, as usual in files, through which, for instance, a finger can be put to pull the file out of a cabinet. The cover 1, in particular the spine 4, can be simply provided on the outside with parts that can be written on, for instance by in-mold labeling. Also, on the outside 11 and/or the inside of the cover 1, a finishing layer, for instance texture, may be provided by means of in-mold labeling technique, printing technique or the like. Texture may also be obtained by appropriate adjustment of the respective wall parts of the mold.

Figure 3:
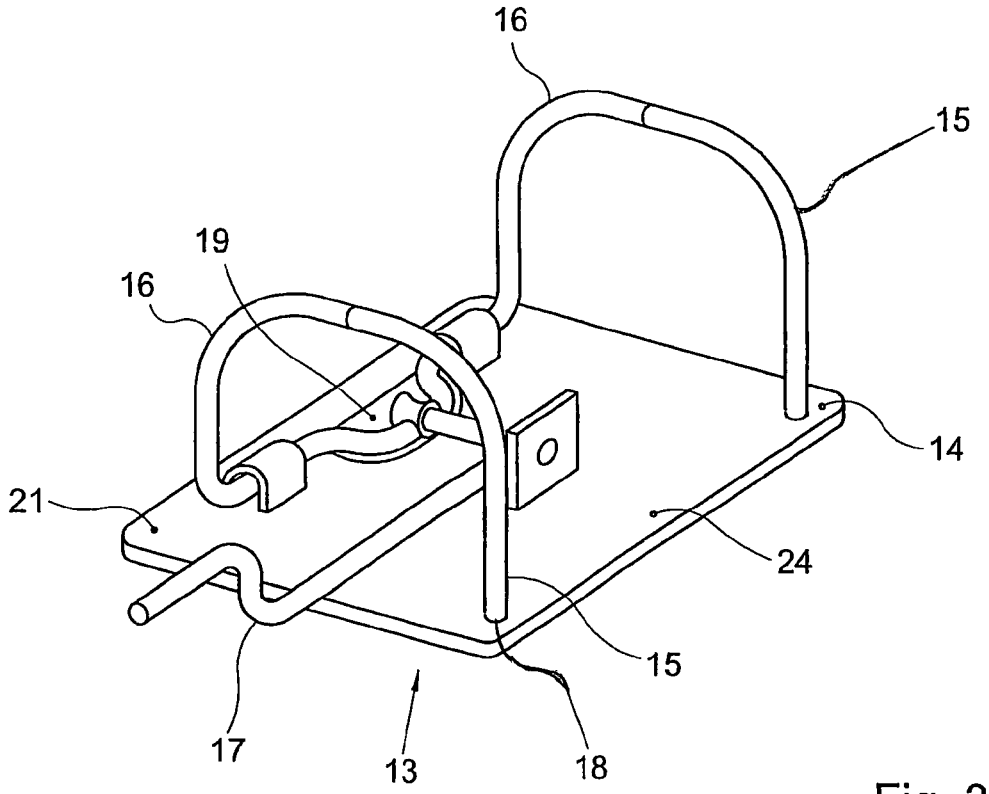
FIG. 3 diagrammatically shows, in perspective view, an arch for a file according to the invention.

On the back cover 3 near the spine 4 are provided first coupling means 12 in which an arch 13, for instance as shown in FIG. 3, can be fixed after forming the cover 1, more in particular previous to use of the file 100. Such arches 13 are sufficiently known from practice for files. The arch 13 will therefore not be described in more detail as far as not necessary for a proper understanding of the invention.

Figure 5:
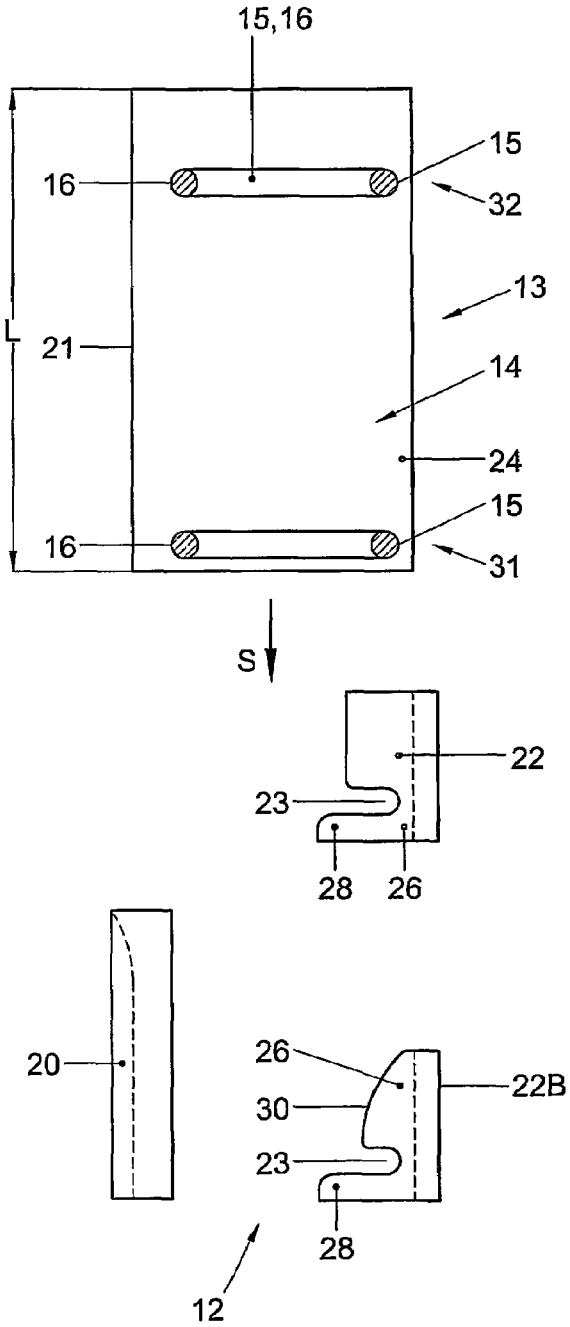
FIGS. 5-7 show, in three steps, the positioning of an arch according to FIG. 3 in a cover according to FIGS. 1 and 2.
Figure 6:
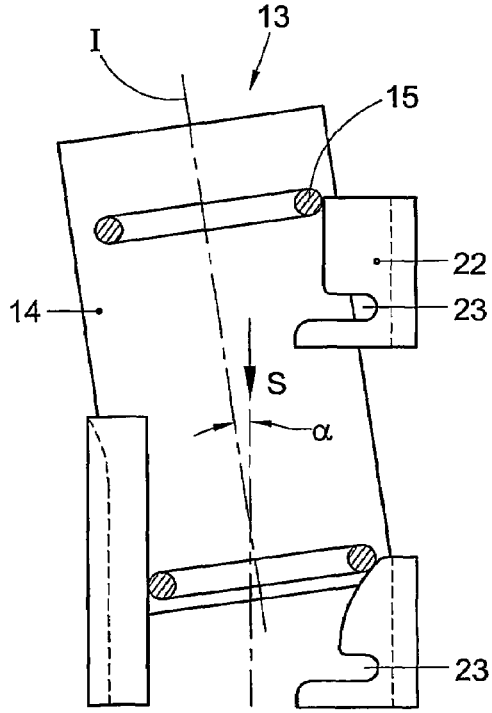
Figure 7:
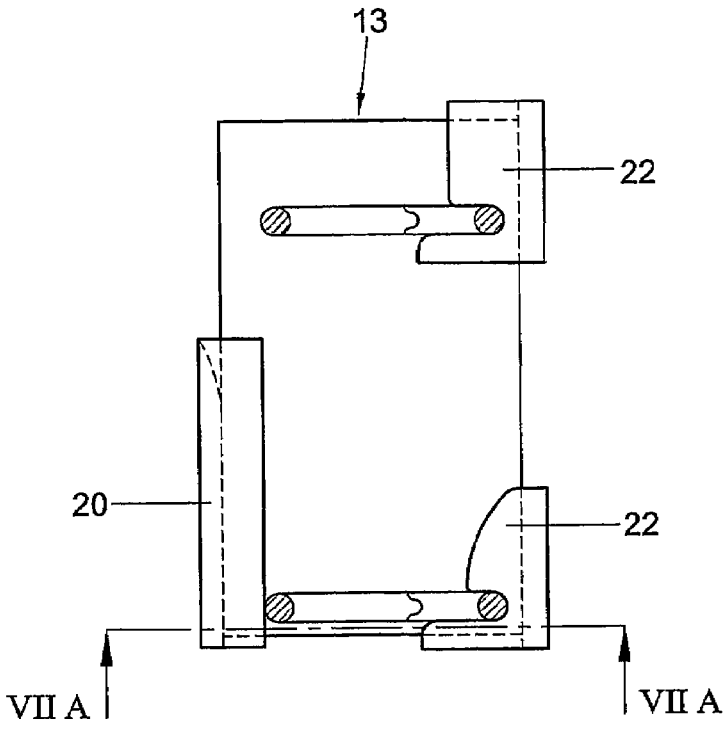

The arch 13 comprises a baseplate 14, for instance with a substantially rectangular, rounded outer form. Fastened to the baseplate are two bent front legs 15 and interconnected back legs 16, which are likewise bent and can be moved against the front legs 15 or pivoted away therefrom by means of a lever 17, in which latter position paper and the like can be slid over the front legs 15 with appropriate perforations. The front legs 15 are connected with the baseplate 14 in a position-stable manner. The baseplate 14 and the front legs 15 together substantially form second coupling means 18, which can cooperate with the first coupling means 12, in a manner to be specified, for fixing the arch 13 in the cover 1. The first coupling means comprise guide means 20, which can cooperate with at least a longitudinal edge 21 of the baseplate 14 as second guide means, two clamping means 22 being provided in the first coupling means for fixing the arch 13 in the guide means 20. To this end, the clamping means 22 are provided with recesses 23, in which the front legs 15 can be fixed. In FIGS. 5-7 is specified in three steps how the arch is fixed in the first coupling means 12. For clarity's sake, the arch 13 is shown in FIGS. 5-7 only diagrammatically, while omitting the pivoting arm 17, spring means 19 and the like. The legs 15, 16 are shown on the baseplate 14 in cross-section, the further legs 15, 16 being diagrammatically shown therebetween (in projection).

Figure 7A:
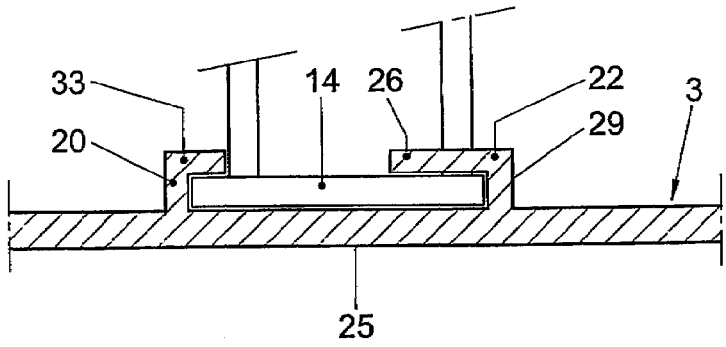

The first coupling means 12 comprise a first guide means 20 in the form of a substantially straight guide with an approximately L-shaped cross-section. As apparent from FIG. 4, this guide element 20 is placed such that the longitudinal edge 21 of the baseplate 14 can be slid thereunder over, for instance, half the length L of the baseplate 14, such that the longitudinal edge 21 is held thereunder. Placed at a distance from the guide element 20 are two clamping elements 22, likewise having a substantially L-shaped cross-section, such that the second longitudinal edge 24 situated opposite the longitudinal edge 21 can be slid thereunder. This situation is shown in FIG. 7*a* in cross-sectional view. It is clear that then the baseplate 14 is enclosed between, on the one hand, the surface 25 of the back cover 3 and, on the other hand, the guide element 20 and the clamping elements 22. The clamping elements 22 each comprise a flange 26, which extend approximately parallel to the surface 25 of the back cover 3, in which flanges 26 the recesses 23 are provided. The recesses 23 are open toward the side facing the guide element 20. In leading position seen in the slide-in direction S, a tongue 28 is provided behind each recess 23, which tongue projects from the wall 29 farther than the opposite flange part 30 and serves as catch means.

The arch 13 can be placed as follows.

The arch is placed with the baseplate 14 on the back cover 3, slightly beside the, in FIGS. 5, 6 and 7 upper, clamping element 22, the baseplate 14 being slightly rotated, such that the longitudinal axis I thereof encloses an angle $\alpha$ with the slide-in direction S. Subsequently, the first arch 31, shown at the bottom of FIG. 5, is slid along the upper clamping element 22A to between the guide element 20 and the flange part 30 of the lower clamping element 22B. This position is shown in FIG. 6. Subsequently, the arch 13 is pushed further in the slide-in direction S, thereby slightly elastically deforming at least the clamping elements 22, until the lower arch 31 strikes against the tongue 28 of the lower clamping element 22B, while the respective front leg 15 of the arch 31 is received in the respective recess 23. Then the front leg 15 of the other arch 32 will be automatically received in the opening 23 of the, in FIG. 6 upper, clamping element 22A, such that the longitudinal axis I is rotated back, until it extends parallel to the slide-in direction S. In this condition, the arch 13 is secured in the first coupling means 12 against any movement, as shown in FIG. 7. The guide element 20 and/or the clamping elements 22, which are slightly elastically deformed when slid in, will assume their original form again to even better fix the arch 13. Optionally, a further recess (not shown) may be provided in the horizontal flange 33 of the guide element 20, in which recess the back leg 16 of the lower arch 31 can be received, so that the arch 13 is even better secured against movement, in particular rotation.

Figure 7B:
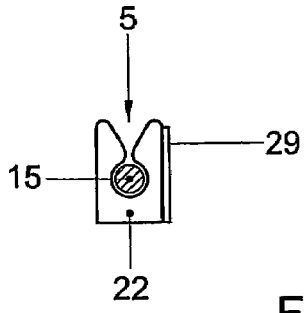

It will be clear that all kinds of other means may also be provided for fixing the arch 13 to the cover 1, in particular against the back cover 3, for instance click means gripping around the legs, as diagrammatically shown in FIG. 7B, where the front leg 15 and/or the back leg 16 can be simply slid in the slide-in direction S, but yet cannot be pulled loose therefrom anymore. In a comparable manner, such a clamping element 22 may be connected with the surface 25 via a raised wall part 29. Also, for instance on the cover 3, there may be provided pins, which extend approximately at right angles to the surface 25 or enclose an obtuse angle therewith, which pins can elastically deform when the baseplate 14 is slid on and can spring back into openings in the baseplate, while, again, for instance longitudinal edges 21, 24 of the baseplate 14 are guided by guide elements, such as guide element 20. These and many variations are deemed to fall within the scope of the invention as defined by the claims.

A file 100 according to the invention can be used as follows.

Figure 4:
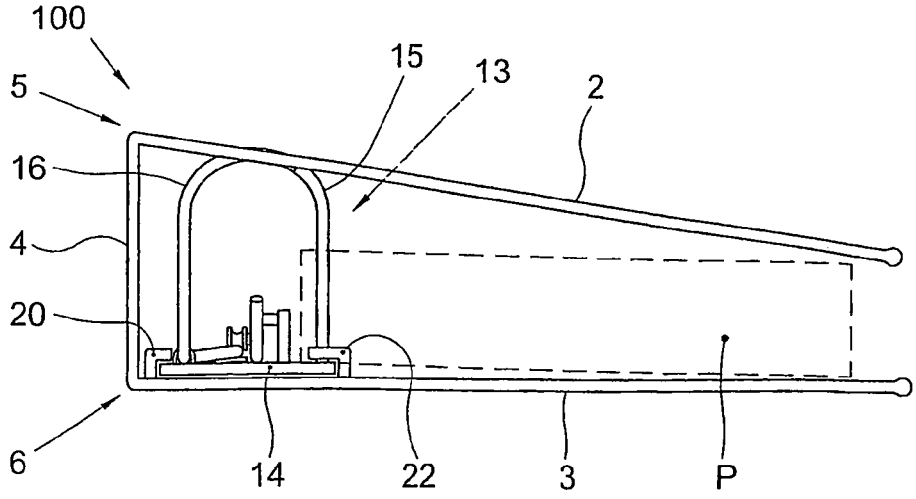
FIG. 4 shows, in side view, a file according to the invention, in closed condition, composed of a cover of FIGS. 1 and 2 and an arch according to FIG. 3.

A series of covers 1 is placed in flat condition in a container, for instance a box, in which the covers 1 can be simply packed in a compact manner. Here, unlike existing files, there is practically no loss of space within the container. An equal number of arches 13 is packed apart from the covers 1, at least separately therefrom. In this condition, the arches are transported to users. Previous to use, a cover 1 is taken from the container, an arch 13 is fixed thereon, preferably in the manner as described above, after which the file is ready for use. Paper and the like, as shown in FIG. 4 in broken lines, can be fixed on the arch 13, in a manner known per se. Subsequently, the file 100 can be closed by folding the front cover 2 over the paper P. Provided in the front cover 2 are two openings 40 with clamping lips 41, as in known files, with which the front cover 2 can be fixed on the arch 13, in particular the legs 15, 16.

In FIG. 8 is shown a mold 50, comprising a first part 51 and a second part 52, in which second part 52 is provided a movable wall part 53, operable from outside the mold 50 by arms 54, diagrammatically shown in FIGS. 8 and 9. Provided inside the mold 50 is a mold cavity 55, a part of which is defined by the movable wall part 53, in which mold cavity 55 the cover 1 can be formed. At the start of injection molding, plastic is brought into the mold cavity 55 with withdrawn movable wall part 53, that is to say the space of the mold cavity 55 is relatively large. Subsequently, when the mold cavity 55 is nearly completely filled with plastic, for instance more than 80%, the movable wall part 53 is moved in the direction of the first part 51, so that the volume of the mold cavity decreases, until the desired final volume, while or after which afterpressure is applied in the conventional manner to completely fill the mold cavity and to obtain a substantially stress-free product. In the position shown in FIG. 9, a cover 1 is formed in a completely dimensionally stable manner. It is clear that during injection molding the mold 50 is kept closed, as diagrammatically shown by closure elements 56. With such a method, a cover that is relatively dimensionally stable can be manufactured in a very simple manner, using relatively light tools, while, moreover, a high degree of freedom in the choice of plastic is obtained. In fact, as a result of the movable wall part, broad flow paths are obtained during the largest part of the filling of the mold, so that both high-melt and very low-melt plastics can be used.

The invention is in no way limited to the exemplary embodiments described in the specification and shown in the drawings. Many variations thereof are possible within the scope of the invention defined by the claims.

Thus, the arches may be fixed on the cover in various manners. For instance, screw means, clamping means and the like may also be used, in particular for the use of a described method in which covers and arches are delivered separately and are only composed preferably directly before use. With such a method, special advantages are obtained, in particular during storage and transport. In such a method, for that matter, other types of materials may be used as well, for instance covers partly or completely formed from cardboard or plastic plate and the like. Covers for use in a file according to the invention may also be injection molded in another manner, in other more conventional injection molding devices. As described, different arches may be used as well, for instance two-, three- or multi-ring binders that can be fixed on a cover in the same or in a comparable manner. Optionally, arches may also be placed from an outside of the cover, by pushing the legs through slit-shaped openings and fixing them on the inside.

These and many comparable variations are deemed to fall within the scope of the invention as defined by the claims.

The invention claimed is:

1. A file comprising:

a cover provided with at least a front cover portion, a back cover portion, a spine and coupling means provided on one of the cover portions or the spine for fastening an arch to the cover after it has been injection molded, said coupling means being co-injection molded in the file, wherein the front cover, the back cover and the spine are manufactured in one piece from plastic, and include hinges being co-formed therebetween for connecting the covers with the spine, and wherein the coupling means comprise clamping means, with which the arch can be fixed to the cover, said clamping means including a flange spaced from one of the cover portions and/or the spine and a recess formed in said flange; and an arch coupled to said coupling means for fastening paper in said cover, said arch including a substantially planar base plate having an edge and at least one leg extending upwardly from said base plate, said base plate edge being retained under said clamping means flange and said upwardly extending leg being received in said flange recess, wherein said arch is snap-fit coupled to said coupling means without having to fold over any part of said coupling means to establish said snap-fit coupling between said arch and said coupling means.

2. A file according to claim 1, wherein the coupling means further comprise guide means disposed opposite the clamping means for sliding in the base plate edge of the arch, clamping means being provided to fix the arch in the guide means when the arch has been slid in completely.

3. A file according to claim 2, wherein the clamping means further comprises a wall extending upwardly from one of the cover portions or the spine, said flange extending outwardly from said wall in a direction toward said guide means and defining a substantially L-shaped cross-section for retaining said edge of said arch base plate under said clamping means flange.

4. A file according to claim 3, wherein said recess is open in a direction facing the guide means.

5. A file according to claim 3, wherein said clamping means further comprises a tongue adjacent the flange recess, said tongue extending outwardly from said wall in a direction toward said guide means a distance greater than said flange.

6. A file according to claim 1, wherein the arch is co-injection molded in the file with the coupling means as an insert.

7. A file according to claim 1, wherein at least a part of the spine is provided on the outside with a surface that can be written on, which surface is provided by labeling.

8. A file according to claim 7, wherein said surface is provided by in-mold labeling.

9. A file according to claim 1, wherein the covers and/or the spine are provided with stiffening ribs on the sides thereof facing inward during use.

10. A file according to claim 1, wherein at least the outsides of the covers are provided with texture by in-mold labeling.

11. A file according to claim 1, wherein the clamping means further comprises a wall extending upwardly from one of the cover portions or the spine, said flange and said wall defining a substantially L-shaped cross-section for retaining said edge of said arch base plate under said clamping means flange.

12. A file according to claim 1, wherein said arch base plate is in direct contact with one of the cover portions or the spine.

13. A file according to claim 1, wherein said arch is made from a metallic material.

14. In combination:

a set of plastic covers, each cover comprising at least a front cover portion, a back cover portion and a spine interconnected by hinges, wherein first coupling means are integrally molded in the cover, said first coupling means including clamping means having a flange spaced from the cover and a recess formed in the flange; and a set of metallic arches for clamping paper, each arch being provided with second coupling means cooperating with the first coupling means for selective coupling of said arches to said covers, said second coupling means comprising a substantially planar base plate having an edge and at least one leg extending upwardly from said base plate, said base plate edge being retained under said clamping means flange and said upwardly extending leg being received in said flange recess upon coupling of said arch to said cover, wherein said arch is snap-fit coupled to said first coupling means without having to fold over any part of said first coupling means to establish said snap-fit coupling between said arch and said first coupling means.

15. A method for presenting files comprising the steps of:

providing plastic covers, each cover comprising a front cover portion, a back cover portion and a spine interconnected by hinges, which covers are integrally molded with first coupling means comprising clamping means, said clamping means including a flange spaced from the cover and a recess formed in said flange; and providing metallic arches adapted to fix paper, said arches including second coupling means cooperating with the first coupling means for selective coupling of said arches to said covers, said second coupling means comprising a substantially planar base plate having an edge and at least one leg extending upwardly from said base plate, said base plate edge being retained under said clamping means flange and said upwardly extending leg being received in said flange recess, upon coupling of said arch to said cover, wherein the covers and arches are provided apart from each other, such that a cover and at least one arch can be combined to a file directly before use, and wherein said arch is snap-fit coupled to said first coupling means without having to fold over any part of said first coupling means to establish said snap-fit coupling between said arch and said first coupling means.

16. A method according to claim 15, wherein the covers are injection molded with integrated hinges.

* * * * *